US006889486B2

(12) United States Patent
Christian

(10) Patent No.: US 6,889,486 B2
(45) Date of Patent: May 10, 2005

(54) METHOD FOR THE PRODUCTION OF PACKS OF ROLLS OF PAPER ARRANGED IN TWO OR MORE ROWS

(75) Inventor: Zagnoni Christian, Calcara di Crespellano (IT)

(73) Assignee: T.M.C. S.p.A., Bologna (IT)

( * ) Notice: Subject to any disclaimer, the term of this patent is extended or adjusted under 35 U.S.C. 154(b) by 0 days.

(21) Appl. No.: 10/442,800

(22) Filed: May 21, 2003

(65) Prior Publication Data

US 2003/0217529 A1 Nov. 27, 2003

(30) Foreign Application Priority Data

May 24, 2002 (IT) ..... BO2002A0319

(51) Int. Cl.[7] ..... B65B 11/22
(52) U.S. Cl. ..... 53/466; 53/230
(58) Field of Search ..... 53/466, 228, 230, 53/231

(56) References Cited

U.S. PATENT DOCUMENTS 3,212,230 A * 10/1965 Coates ..... 53/228
3,855,758 A 12/1974 Walter et al.
4,035,990 A * 7/1977 Hallam ..... 53/228
4,279,116 A 7/1981 James et al.
4,313,290 A * 2/1982 Furuya et al. ..... 53/230
5,081,821 A * 1/1992 Meives ..... 53/466
5,406,774 A 4/1995 Dodge
6,067,780 A 5/2000 Gentili et al.

OTHER PUBLICATIONS

European Search Report corresponding to EP Application No. EP 03 01 1616.

* cited by examiner

*Primary Examiner*—John Sipos
(74) *Attorney, Agent, or Firm*—Fay, Sharpe, Fagan, Minnich & McKee, LLP

(57) ABSTRACT

In a machine for the production of packs of rolls of paper, comprising a supporting surface designed to lift the rolls of paper, arranged in two or more rows, towards a zone in which there is a sheet of plastic film, in particular polyethylene, to be wrapped around the rolls to form the pack, the sheet is closed on the lower side of the pack by initiating a process for activating sheet horizontal flat folders, suitably combined with the return stroke of the two parts of which the supporting surface consists. The process allows correct closing of the two flaps of plastic film on the lower side of the pack, guaranteeing the stability of the configuration of the various rows of rolls.

7 Claims, 2 Drawing Sheets

METHOD FOR THE PRODUCTION OF PACKS OF ROLLS OF PAPER ARRANGED IN TWO OR MORE ROWS

BACKGROUND OF THE INVENTION

The present invention relates to a method for the production of packs of rolls of paper arranged in two or more rows.

Specifically, but not exclusively, the present invention is usefully applied for the production of packs of rolls of toilet paper arranged in five adjacent rows.

In the production of packs of rolls, in particular of toilet paper, machines are currently used which comprise elevator supporting surfaces, that can move vertically from a lower position in which they receive rolls of paper from roll production machines, to an upper position in which a sheet of plastic film, in particular made of polyethylene, is wrapped around the set of rolls to form the pack.

Said mobile supporting surfaces consist of two parts, mobile relative to one another, in such a way that, when there are three or more rows of rolls, as in the example illustrated in FIG. 1*a*, support for the central rows is guaranteed by the central part 1 of the supporting surface, whilst the outer part 2 of the supporting surface is withdrawn to the lower position and the horizontal flat folders 3, 4 are inserted under the rolls to join the two flaps of plastic film 5 together and so close the pack.

The central part 1 of the elevator surface is also withdrawn to the position in which new rolls are received, after the two ends of the horizontal flat folders 3, 4 make contact, during their forward movement towards the center of the structure, with the rolls in the central rows, supporting them in place of the above-mentioned central part of the elevator surface.

However, if the number of rows of rolls increases, as illustrated in the example in FIG. 1*b*, the problem of supporting one or more central rows while the horizontal flat folders move forwards towards the center of the pack arises again.

FIG. 1*b* shows how, unless a third mobile part is incorporated in the elevator supporting surface, at least the central row of rolls is left without any support when the mobile central part of the elevator is withdrawn towards the position in which the rolls are received, and so the stability of the central row becomes very precarious, since interaction with the adjacent rows as a result of possible interference between the diameters of the various rolls may not be sufficient.

The aim of the present invention is to overcome the above-mentioned disadvantage, at the same time avoiding any increase in machine structural complexity with the introduction of more mobile elements in the elevator supporting surface.

Another aim of the present invention is to propose a process for the automatic production of packs of rolls which is extremely rational and reliable.

Accordingly, the present invention fulfils the aforesaid aims with a method for the production of packs of rolls of paper in a packaging machine of the type comprising at least one supporting surface designed to lift ordered rows of rolls of paper from a first position, in which the rolls are received from roll production machines, to a second position, where a sheet of plastic film, in particular polyethylene, is stretched transversally to the direction of feed of the rolls. The rows of rolls are thrust against the sheet so that it is wrapped around the upper part and sides of the rows and the horizontal flat folders are activated to close the sheet flaps over the lower part of the rows. The supporting surface consists of two mobile parts, one at the center of the other, which can be activated separately for the return movement to the position in which the rolls are received, wherein the closing of the lower surface of the pack includes the steps of:

forward movement of the horizontal flat folders until the folders are close to the outer mobile part of the elevator supporting surface, movement of the outer mobile part of the supporting surface to the position in which the rolls are received, forward movement of the horizontal flat folders until they are close to the central mobile part of the elevator supporting surface, downward movement of the central mobile part of the supporting surface, by an amount equal to the thickness of the horizontal flat folders, stopping the central mobile part in the lowered position, forward movement of the horizontal flat folders towards the plastic film sheet closing position, movement of the central mobile part of the supporting surface towards the position in which the rolls of paper are received.

The central mobile part of the elevator surface stops in the intermediate position until the two ends of the flat folders make contact with the lower roll in the central row of rolls.

The two parts of which the elevator supporting surface consists may move at different speeds during the return step towards the position in which the rolls are received. In particular, the central part may, after an intermediate stop, move with a speed which allows it to reach the position in which the rolls are received practically simultaneously with the outer part of the supporting surface and thus restore surface continuity in the shortest possible time.

Closing of the polyethylene plastic film around the rows of rolls is completed, in a known way, with an operation for sealing the two end flaps of the sheet of polyethylene film with a sealing bar pressed against the overlapping flaps when the two flat folders are returned to the respective starting positions.

The features and advantages of the method disclosed are immediately evident from the above description, both relative to the possibility of continuing to use the machines currently in service, without changing the structural configuration, and as regards maintenance of a high level of hourly productivity associated with the method.

BRIEF DESCRIPTION OF THE DRAWINGS

The features and advantages of the present invention are more clearly illustrated in the detailed description below, with reference to the accompanying drawings, which illustrate a preferred embodiment of the invention without limiting the scope of the inventive concept, and in which.

DESCRIPTION OF THE PREFERRED EMBODIMENTS

Figure 1A:
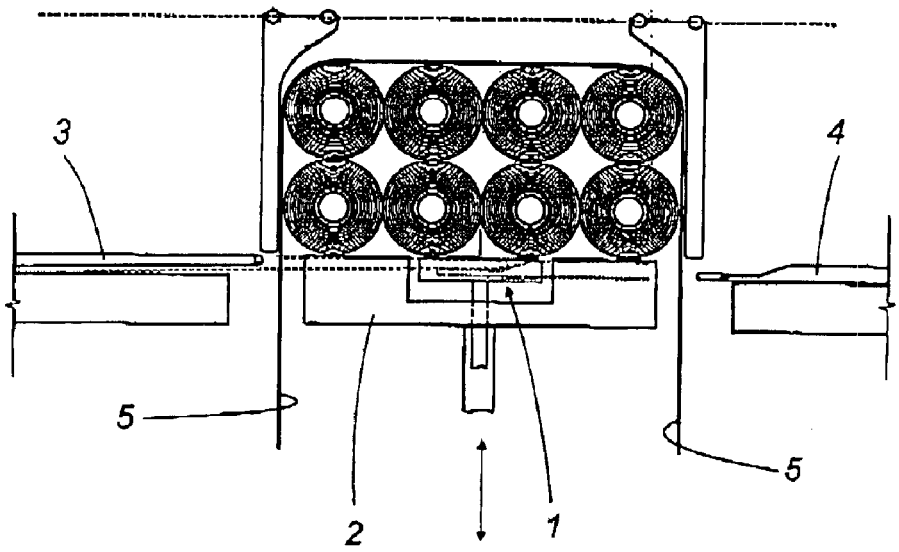
FIG. 1*a* is a schematic front view of a part of a machine for the production of packs of rolls of paper operating with the maximum number of rows currently configurable.
Figure 1B:
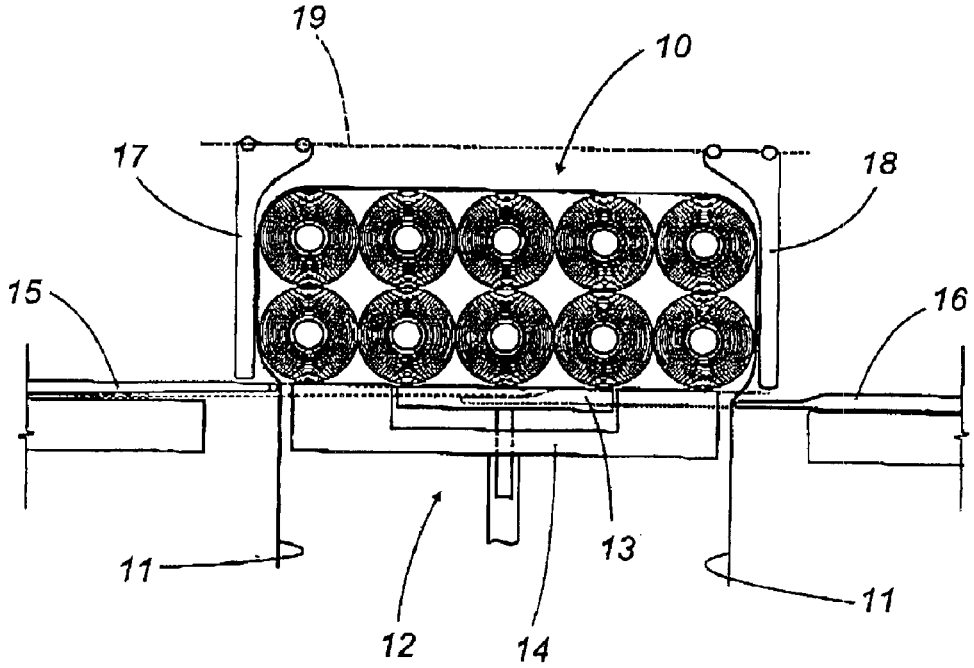
FIG. 1*b* is a schematic front view of the part of the packaging machine illustrated in FIG. 1*a* operating, in accordance with the present invention, with packs of rolls comprising a larger number of rows, and, in particular, five rows.

With reference to FIG. 1*b*, the numeral 10 denotes a set of rolls of paper consisting of five rows as a whole, each row having two rolls, precisely arranged in the packaging layout.

The sheet of plastic film 11 has already been wrapped around the three sides of the set 10, as illustrated, thanks to the upward movement of the set by the elevator supporting surface 12. In accordance with the prior art, the elevator supporting surface consists of two parts 13, 14, mobile relative to one another, on which the rolls are deposited, in a special reception location not illustrated, by a specific multiple feed apparatus.

Figure 2:
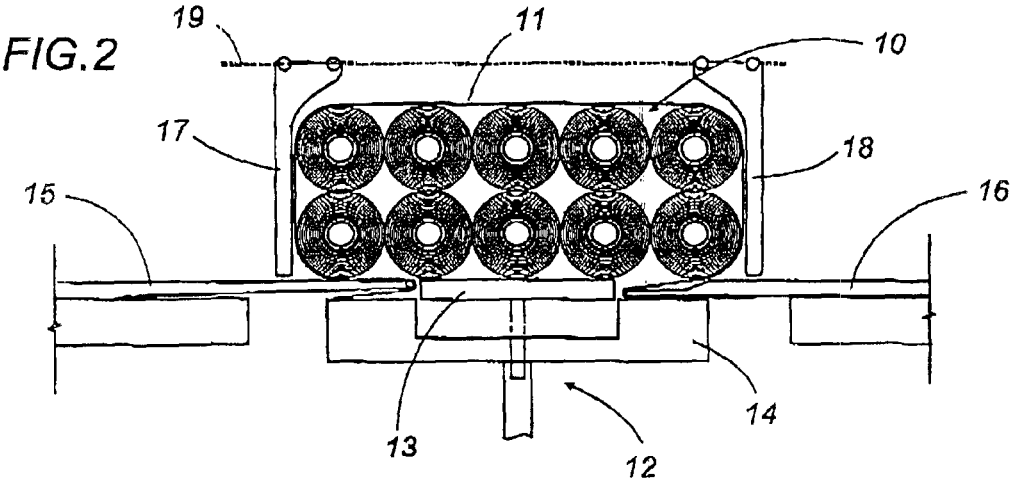
FIGS. 2, 3 and 4 illustrate the different successive configurations assumed by the elements of the machine illustrated in FIG. 1*b* when implementing the method in accordance with the present invention.

The situation illustrated in FIG. 1*b* refers to precisely the moment when the two flat folders 15, 16, during their horizontal movement, reach a position close to the outer mobile part 14 of the supporting surface 12. At this point, the outer mobile part is withdrawn downwards towards the position in which the rolls are received, then the flat folders 15, 16 can continue their forward movement towards the center of the structure, supporting the outer rows of rolls, as illustrated in FIG. 2.

In the meantime, the other three rows of rolls are still supported by the central mobile part 13 of the supporting surface, until the flat folders reach a position close to the central part 13 and the central part is also moved downwards. When this happens, the ends of the flat folders 15, 16 are practically able to support the two intermediate rows of rolls, but not the central row which, therefore, may completely or partially follow the movement of the central part 13 of the supporting surface. Therefore, to prevent the central row from being irreparably displaced, the downward movement of the central mobile part 13 is interrupted as soon as the central mobile part has moved by an amount at least equal to the thickness of the horizontal flat folders 15, 16, so that the latter may move forwards and, if necessary push the central row upwards again. However, in any case, the horizontal flat folders are positioned under the central row, supporting it level with the others.

Figure 3:
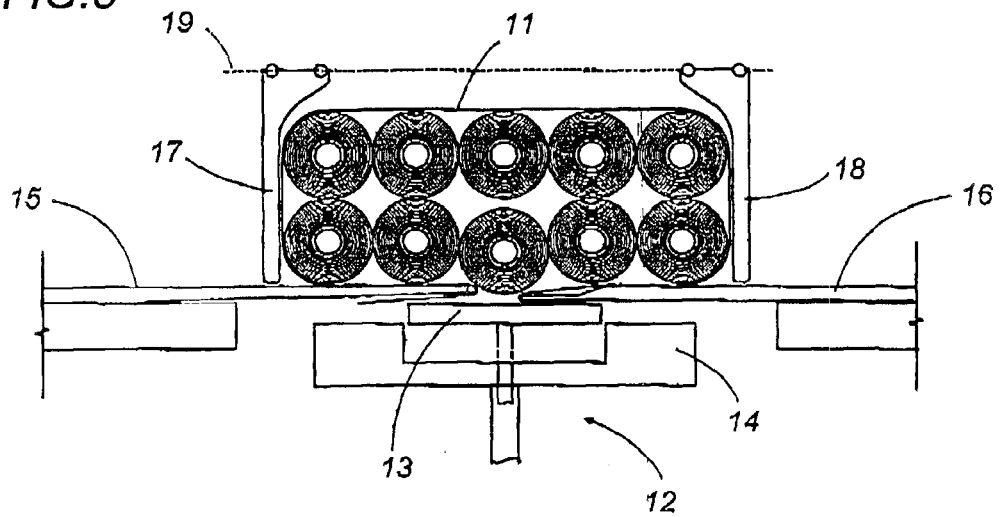

FIG. 3 illustrates the moment when, with the central part 13 of the supporting surface 12 stationary in the intermediate stop position, the ends of the horizontal flat folders 15, 16 are practically supporting the lower roll of the central row, pushing it upwards.

Figure 4:
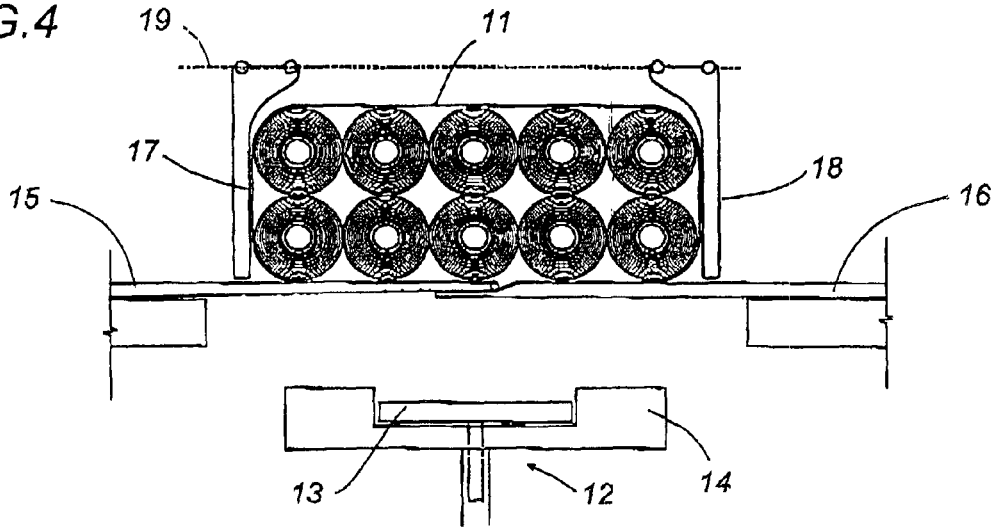

As illustrated in FIG. 4, the ends of the flat folders are shaped in such a way that they overlap one another precisely by a section sufficient to cause vertical overlapping of the end flaps of the sheet of plastic film 11.

The subsequent steps of the method for the production of packs of rolls of paper involve, in accordance with the prior art, an operation for sealing the flaps of the sheet 11 by bringing a sealing bar against the section of overlapping surfaces, then transferring the set of rolls 10 using feed teeth 17, 18 moved by a chain 19, to operating stations where closing of the front surfaces of the pack is completed.

The present invention is suitable for evident industrial applications. The advantages of simple application and effective operation of the pack production method proposed are immediately evident in the above description, and it is obvious that such features are retained even if modifications and variations are made to the embodiment described above.

The method disclosed may also be advantageously applied for the production of packs of rolls comprising a smaller or larger number of rows than described in the example.

The relative dimensions of the two parts of the supporting surface 12 may vary, provided they still guarantee support respectively for the side rows and the central rows of the set of rolls.

Obviously, the return of said mobile parts of the supporting surface to the position in which they receive the rolls may occur in various ways, for example by synchronizing the moments of arrival of the two parts in said position, or making the parts reach the position separately. Whatever the case, this all occurs after the central part 13 has stopped in the intermediate position illustrated in FIG. 3 for a suitable period of time for achievement of the above-mentioned aims.

Obviously, the present invention may be subject to other practical—application modifications without thereby departing from the scope of the inventive concept as defined in the claims herein.

What is claimed is:

1. A method for the production of packs of rolls of paper in a packaging machine of the type comprising at least one supporting surface designed to lift ordered rows of rolls of paper from a first position, in which the rolls are received from roll production machines, to a second position, in which a sheet of plastic film is stretched transversally to the direction of feed of the rolls, the rolls being thrust against the sheet so that it is wrapped around the upper part and sides of the rows of rolls, and in which horizontal flat folders are activated, closing the sheet flaps over the lower part of the rows, the supporting surface consisting of two mobile parts, one at the center of the other, which can be activated separately for the return movement to the position in which the rolls are received, wherein the closing of the lower surface of the pack includes the steps of:

forward movement of the horizontal flat folders until the folders are close to the outer mobile part of the elevator supporting surface, movement of the outer mobile part of the supporting surface towards the position in which the rolls are received, forward movement of the horizontal flat folders until the folders are close to the central mobile part of the elevator supporting surface, said horizontal flat folders spaced from a lower roll in a central row of rolls, downward movement of the central mobile part of the supporting surface, by an amount equal to the thickness of the horizontal flat folders, to an intermediate lowered position before contact of said horizontal flat folders with said lower roll in said central row of rolls, stopping the central mobile part in the intermediate lowered position and moving said horizontal flat folders forward until the flat folders make contact with said lower roll in said central row of rolls, forward movement of the horizontal flat folders towards the plastic film sheet closing position, movement of the central mobile part of the supporting surface towards the position in which the rolls of paper are received.

2. The method for the production of packs of rolls of paper according to claim 1, wherein the packs consist of five rows of rolls.

3. The method according to claim 1, wherein the two parts of which the supporting surface consists move towards the position in which the rolls of paper are received at different speeds.

4. The method for the production of packs of rolls of paper according to claim 1, wherein pack production is completed using the further steps of:

sealing the overlapping end flaps of the sheet of plastic film, moving the pack of rolls horizontally towards operating stations designed to close the front surfaces of the pack by automatically folding the plastic film sheet flaps positioned at the front surfaces.

5. The method for the production of packs of rolls of paper according to claim 2, wherein pack production is completed using the further steps of:

sealing the overlapping end flaps of the sheet of plastic film, moving the pack of rolls horizontally towards operating stations designed to close the front surfaces of the pack by automatically folding the plastic film sheet flaps positioned at the front surfaces.

6. The method for the production of packs of rolls of paper according to claim 1, wherein pack production is completed using the further steps of:

sealing the overlapping end flaps of the sheet of plastic film, moving the pack of rolls horizontally towards operating stations designed to close the front surfaces of the pack by automatically folding the plastic film sheet flaps positioned at the front surfaces.

7. The method for the production of packs of rolls of paper according to claim 3, wherein pack production is completed using the further steps of:

sealing the overlapping end flaps of the sheet of plastic film, moving the pack of rolls horizontally towards operating stations designed to close the front surfaces of the pack by automatically folding the plastic film sheet flaps positioned at the front surfaces.

* * * * *

UNITED STATES PATENT AND TRADEMARK OFFICE

CERTIFICATE OF CORRECTION

PATENT NO. : 6,889,486 B2
DATED : May 10, 2005
INVENTOR(S) : Christian Zagnoni

It is certified that error appears in the above-identified patent and that said Letters Patent is hereby corrected as shown below:

Title page,
Item [12], should read -- Zagnoni --.
Item [75], Inventor, should read -- Christian Zagnoni, Calcara di Crespellano (IT) --

Signed and Sealed this

Fifth Day of July, 2005

JON W. DUDAS
*Director of the United States Patent and Trademark Office*